US006497324B1

(12) United States Patent
Doak et al.

(10) Patent No.: US 6,497,324 B1
(45) Date of Patent: Dec. 24, 2002

(54) SORTING SYSTEM WITH MULTI-PLEXER

(75) Inventors: Arthur G. Doak, Nashville; Mitchell G. Roe, Franklin; Stephen C. Greene, Kingston Springs, all of TN (US)

(73) Assignee: MSS, Inc., Nashville, TN (US)

( * ) Notice: Subject to any disclaimer, the term of this patent is extended or adjusted under 35 U.S.C. 154(b) by 0 days.

(21) Appl. No.: 09/589,821

(22) Filed: Jun. 7, 2000

(51) Int. Cl.[7] ..... B07C 5/342

(52) U.S. Cl. ..... 209/522; 209/523; 209/524; 209/576; 209/577; 209/587; 209/638; 209/639

(58) Field of Search ..... 209/522, 523, 209/524, 576, 577, 587, 638, 639, 932, 936; 356/239.4, 445

(56) References Cited

U.S. PATENT DOCUMENTS

| | | | | | |
|---|---|---|---|---|---|
| 3,993,899 | A | * | 11/1976 | Chapman | 250/227 |
| 4,131,540 | A | | 12/1978 | Husome et al. | 209/582 |
| 4,631,675 | A | * | 12/1986 | Jacobsen et al. | 364/400 |
| 4,657,144 | A | | 4/1987 | Martin et al. | 209/546 |
| 4,669,878 | A | * | 6/1987 | Meier | 356/319 |
| 4,699,510 | A | | 10/1987 | Alguard | 356/73 |
| 4,812,904 | A | * | 3/1989 | Maring et al. | 358/107 |
| 4,919,534 | A | | 4/1990 | Reed | 356/73 |
| 4,959,538 | A | * | 9/1990 | Swart | 356/239.4 |
| 5,085,325 | A | | 2/1992 | Jones et al. | 209/580 |
| 5,223,312 | A | * | 6/1993 | Langille | 428/31 |
| 5,233,186 | A | * | 8/1993 | Ringlien | 356/239.4 |
| 5,297,667 | A | | 3/1994 | Hoffman | 198/493 |
| 5,314,072 | A | | 5/1994 | Frankel et al. | 209/44 |
| 5,317,656 | A | * | 5/1994 | Moslehi et al. | 385/12 |
| 5,318,172 | A | | 6/1994 | Kenny et al. | 209/524 |
| 5,333,739 | A | | 8/1994 | Stelte | 209/582 |
| 5,442,446 | A | * | 8/1995 | Gerber et al. | 356/428 |
| 5,443,164 | A | * | 8/1995 | Walsh et al. | 209/580 |
| 5,512,758 | A | | 4/1996 | Kobayashi et al. | 250/461.1 |
| 5,516,227 | A | * | 5/1996 | Kozak | 404/9 |
| 5,675,416 | A | * | 10/1997 | Campbell et al. | 356/367 |
| 5,848,706 | A | * | 12/1998 | Harris | 209/580 |
| 5,884,775 | A | | 3/1999 | Campbell | 209/581 |
| 5,926,262 | A | * | 7/1999 | Jung et al. | 356/73 |
| 5,966,217 | A | | 10/1999 | Roe et al. | 356/402 |
| 6,060,677 | A | * | 5/2000 | Ulrichsen et al. | 209/577 |
| 6,212,962 | B1 | * | 4/2001 | Lucas | 73/865.8 |

* cited by examiner

*Primary Examiner*—Donald P. Walsh
*Assistant Examiner*—Joseph C Rodriguez
(74) *Attorney, Agent, or Firm*—Waddey & Patterson; Lucian Wayne Beavers

(57) ABSTRACT

A system for sorting articles includes a feed conveyor for launching the articles across an airspace toward a first destination. A light source shines light energy on the articles in the airspace. A collector collects light energy reflected from the articles. A deflector is provided for deflecting selected articles toward an alternative destination as the articles fly across the airspace. A control system is operably connected to the collector and the deflector for actuating the deflector in response to a sensed parameter, such as an electromagnetic radiation frequency spectrum, of the light energy collected in the collector. Preferably, this system is utilized with a retro-reflector located on an opposite side of the airspace from the light source and the collector. This system also preferably includes the use of a multi-plexer which allows a single analyzer unit to be utilized to analyze light signals from each of a large plurality of collector units of the collector.

15 Claims, 10 Drawing Sheets

SORTING SYSTEM WITH MULTI-PLEXER

BACKGROUND OF THE INVENTION

1. Field of the Invention

The present invention relates generally to systems for separating selected articles from a stream of articles, and more particularly, but not by way of limitation, to a system particularly suited for sorting plastic bottles by color and by material.

2. Description of the Prior Art

A number of different sorting systems have been proposed in the prior art for sorting various articles based upon the color the articles or the characteristics of the reflected or transmitted electromagnetic radiation to which the article is exposed. Such systems have been utilized for sorting glass, plastic, fruit and other edible items, and the like.

A number of arrangements have been provided for carrying the articles through an inspection zone, and for exposing the articles to electromagnetic radiation and then collecting and analyzing the reflected and/or transmitted radiation.

For example, U.S. Pat. No. 4,131,540 to Husome et al. discloses a color sorting system wherein light is reflected off of tomatoes and the reflected light is collected and analyzed as the tomatoes fly through an inspection zone.

U.S. Pat. No. 4,657,144 to Martin et al. discloses a system for removing foreign material from a stream of particulate matter such as tobacco as it cascades through an inspection zone.

U.S. Pat. No. 4,919,534 to Reed, discloses a system for determining the color of glass bottles, wherein the light energy is transmitted through the glass bottles.

U.S. Pat. No. 5,085,325 to Jones et al. discloses a system of a very common type wherein articles are examined as they are supported upon a moving conveyor belt.

U.S. Pat. No. 5,297,667 to Hoffman et al. discloses a system of utilizing two light sources and a camera to analyze articles as they fly through an inspection zone.

U.S. Pat. No. 5,314,072 to Frankel et al. discloses a system which analyzes the transmissive characteristics of articles which are exposed to x-ray fluorescence.

U.S. Pat. No. 5,318,172 to Kenny et al. discloses a system which distinguishes different types of plastic materials based upon their reflected electromagnetic radiation.

U.S. Pat. No. 5,333,739 to Stelte discloses another system which transmits light through articles, namely glass articles, and analyzes the transmitted light to determine color.

U.S. Pat. No. 5,443,164 to Walsh et al. discloses a plastic container sorting system which utilizes both transmitted electromagnetic energy and reflected electromagnetic energy to analyze and identify articles.

U.S. Pat. No. 5,675,416 to Campbell et al. discloses an apparatus which looks at the transmissive properties of articles to separate them based upon the material of the article.

U.S. Pat. No. 5,848,706 to Harris discloses a sorting apparatus which examines optical characteristics of the articles against a viewing background.

U.S. Pat. No. 5,966,217 to Roe et al. discloses a system for analyzing articles wherein reflected radiation is split into a plurality of streams which are then filtered and analyzed.

Thus, it is seen that although there have been many arrangements proposed for the examination of a stream of articles by analysis of reflected and/or transmitted electromagnetic radiation from the articles, there is a continuing need for improved systems.

SUMMARY OF THE INVENTION

A system for sorting articles includes a feed conveyor for launching the articles across an airspace toward a first destination. A light source is provided for shining light energy on the articles in the airspace. A light collector is provided for collecting light energy reflected from the articles in the airspace. A deflector is provided for deflecting selected articles toward an alternative destination as the articles fly across the airspace. A control system is operably connected to the collector and the deflector for actuating the deflector in response to a sensed parameter (such as color) of the light energy collected in the collector.

The light source and collector are placed on one side of the air space and a calibration reflector is located on an opposite side of the airspace. The calibration reflector may be a retro-reflector constructed to reflect light back in a direction opposite and parallel to a direction at which the light falls upon the reflector. Such a reflector provides substantially total reflection of white light so that the sensor system can be calibrated whenever an article is not present in the airspace.

In another embodiment, the collector of the system includes an array of collector elements spaced across the width of the feed conveyor. Each collector element is connected to a light supply conduit which conducts the light energy to a multi-plexer. The multi-plexer receives light from each of the light supply conduits and then sequentially transfers the light from each light supply conduit to a common light transfer conduit. The common light transfer conduit conducts the light energy to a common analyzer unit for analyzing the light from all of the collector elements.

In another aspect of the invention, the multiplexer comprises a stator connected to each of the light supply conduits and connected to the common light transfer conduit. The multiplexer further includes a rotor carrying a light conducting tube for sequentially conducting light from each light supply conduit to the common light transfer conduit as the rotor rotates relative to the stator.

The present invention further includes methods of using the sorting system and its various components.

It is therefore a general object of the present invention to provide improved apparatus and methods for sorting objects by material and/or color, and particularly for sorting plastic bottles and the like.

Still another object of the present invention is the provision of a system for sorting objects wherein the objects are analyzed as they fly through an airspace, thus eliminating problems associated with analyzing objects lying on a supporting surface.

And another object of the present invention is the provision of a multiplexer for receiving multiple parallel streams of light energy and for sequentially conducting those multiple inlet streams to a common outlet stream.

And another object of the present invention is the provision of an improved reflector design for substantially completely reflecting white light energy incident thereon.

Other and further objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
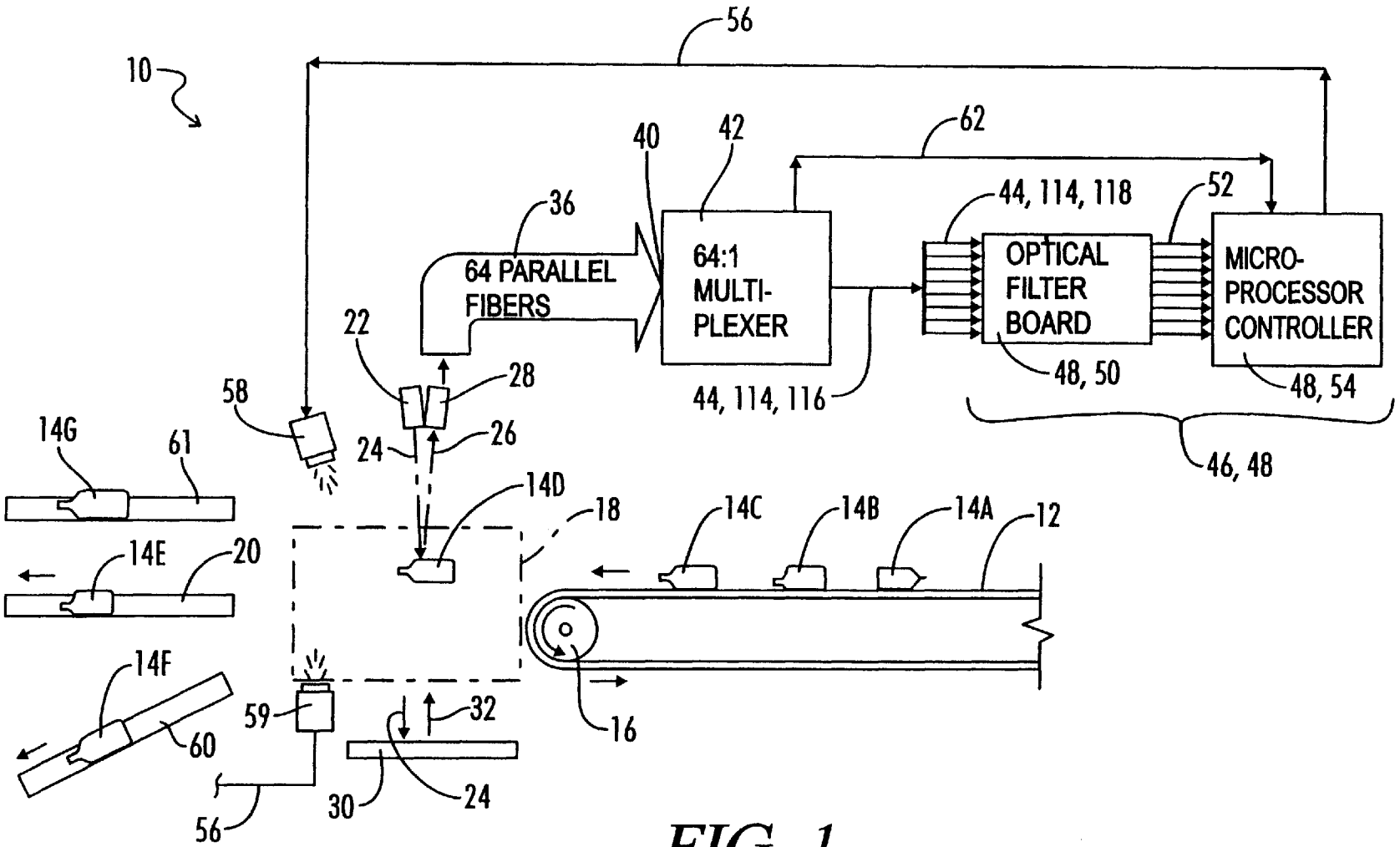
FIG. 1 is a schematic illustration of an article sorting system.

Referring now the drawings, and more particularly to FIG. 1, a system for sorting articles is there schematically shown and is generally designated by the numeral 10. The system 10 includes a feed conveyor 12 which carries a stream of articles 14 thereon which are to be sorted. In the embodiment illustrated, the feed conveyor 12 is an endless conveyor belt driven by a pulley 16 to carry the articles 14 at a pre-determined speed. When the articles 14 reach the end of the conveyor adjacent the drive pulley 16, they are launched through an airspace, generally designated by the numeral 18, toward a first chute 20, which may also be referred to as a first destination 20.

A light source 22 shines light energy 24 on the articles such as article 14D which are located in the airspace 18. The light source is preferably white light including visible light, infrared light and ultraviolet light portions of electromagnetic radiation. It may, for example, be tungsten lights with metal reflectors.

When there is an article 14D in the airspace 18 below the light source 22, light energy 26 will reflect from the article 14D and will be collected by a collector 28. Source 22 and collector 28 are placed as close together as physically possible, e.g. 3 inches, and the bottom of each is slightly tilted toward the other so their alignments converge at the location of article 14D.

When there is no article immediately below the light source 22 and collector 28, the light 24 from source 22 will continue downward until it hits a calibration reflector 30 on the opposite side of airspace 18. The calibration reflector 30 is preferably a retro-reflector constructed to reflect light 32 back in a direction opposite and parallel to the direction at which the light falls upon the reflector 30.

If the article 14D is transparent or clear, a second portion of the incident light will also be transmitted through the article, then reflect off reflector 30, then pass back through the article and to the collector 28.

Such a system which measures and analyzes both reflected and transmitted light from an article may be referred to as a "trans-flection" system.

Figure 3:
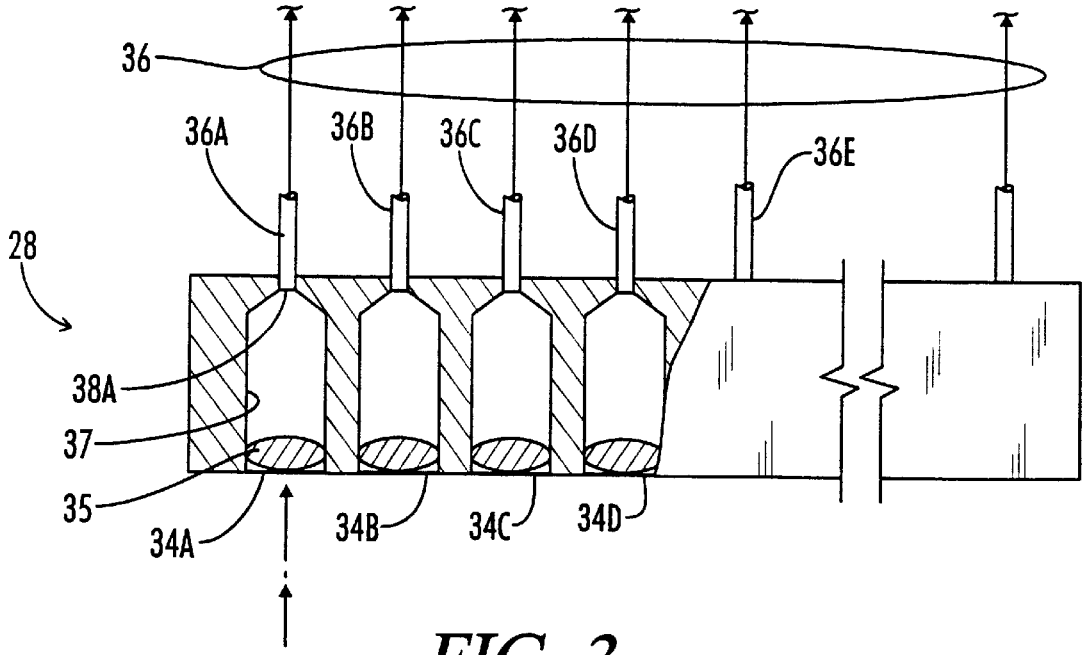
FIG. 3 is a schematic partially cross sectioned view of the light collector of the system of FIG. 1.

As is illustrated in FIG. 3, the collector 28 includes an array of collector elements 34 spaced across a width of the conveyor belt 12. For example, for a conveyor belt 12 having a width of 64 inches, the collector 30 preferably includes 64 of the collector elements 34 spaced one inch apart so that each collector 34 views a one wide strip of the conveyor belt 12.

Each collector element 34 has a optical fiber 36, which may be generally referred to as a light supply conduit 36, having a first end 38 connected to the collector element 34 and having a second end 40 connected to a light beam multiplexer 42.

Each light collector element 34 includes a lens 35 located in a cylindrical collector cavity or bore 37. Preferably, the interior surface of each bore 37 is irregular shaped, and may for example be threaded. This irregular internal surface of bore 37 in combination with the focusing lens 35 causes the light energy falling upon end face 38 of fiber 36 to be substantially entirely light energy which is entering the collector element 34 in a line parallel to central axis thereof.

The light beam multi-plexer 42 receives light from each of the fibers 36 and sequentially transfers the light from each light supply conduit 36 to a common light transfer conduit 44.

The common light transfer conduit 44 is connected to a control system 46 which includes an analyzer 48 connected to the common light transfer conduit 44 for analyzing the light from all of the collector elements 34.

The analyzer 48 includes an optical filter board 40 in which the light energy is filtered and directed to sensors which generate electrical signals which are converted into digital signals which are communicated over electrical conductors 52 to a microprocessor controller 54.

In general, the control system 46 will sense a parameter of the light energy collected by collector 28, and the microprocessor controller 54 will generate a control signal directed over control signal line 56 to a selected one of a plurality of air jets 58. The air jets 58 may be generally described as deflectors 58 for deflecting selected articles 14 toward a second chute 60 which may also be described as an alternative destination 60.

Also, if it is desired to split the stream of articles into three product streams, a second set of air jets 59 can direct product upward to a third chute 61.

As is further described below, the multiplexer 42 will generate an indexing signal which will be carried over indexing signal line 62 to the microprocessor 54 to allow the microprocessor 54 to synchronize the actions of the various components of the system 10.

The Multi-plexer

Figure 4:
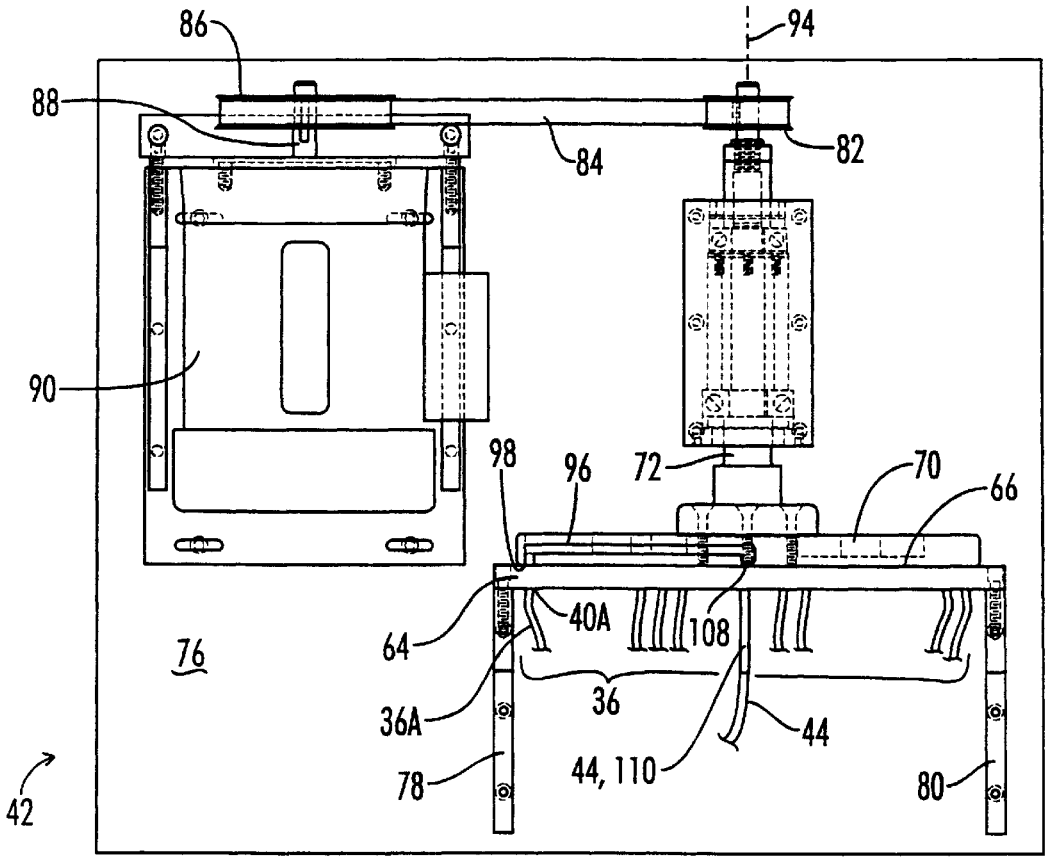
FIG. 4 is a plan view of the multiplexer of the system of FIG. 1.
Figure 5:
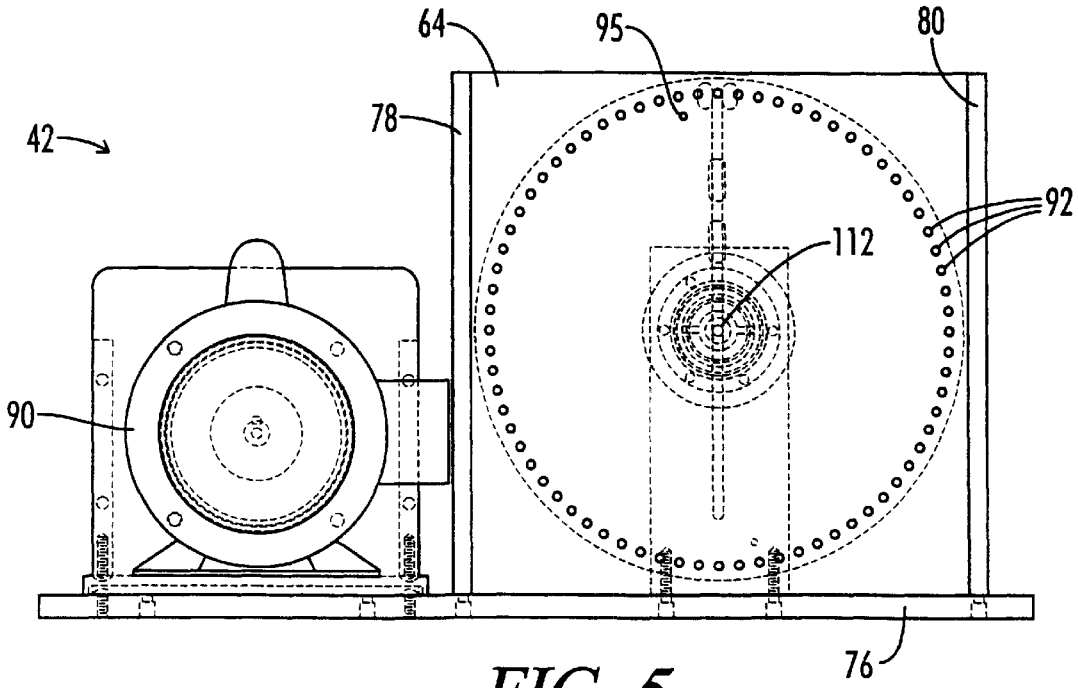
FIG. 5 is a front elevation view of the multiplexer of FIG. 4.
Figure 6:
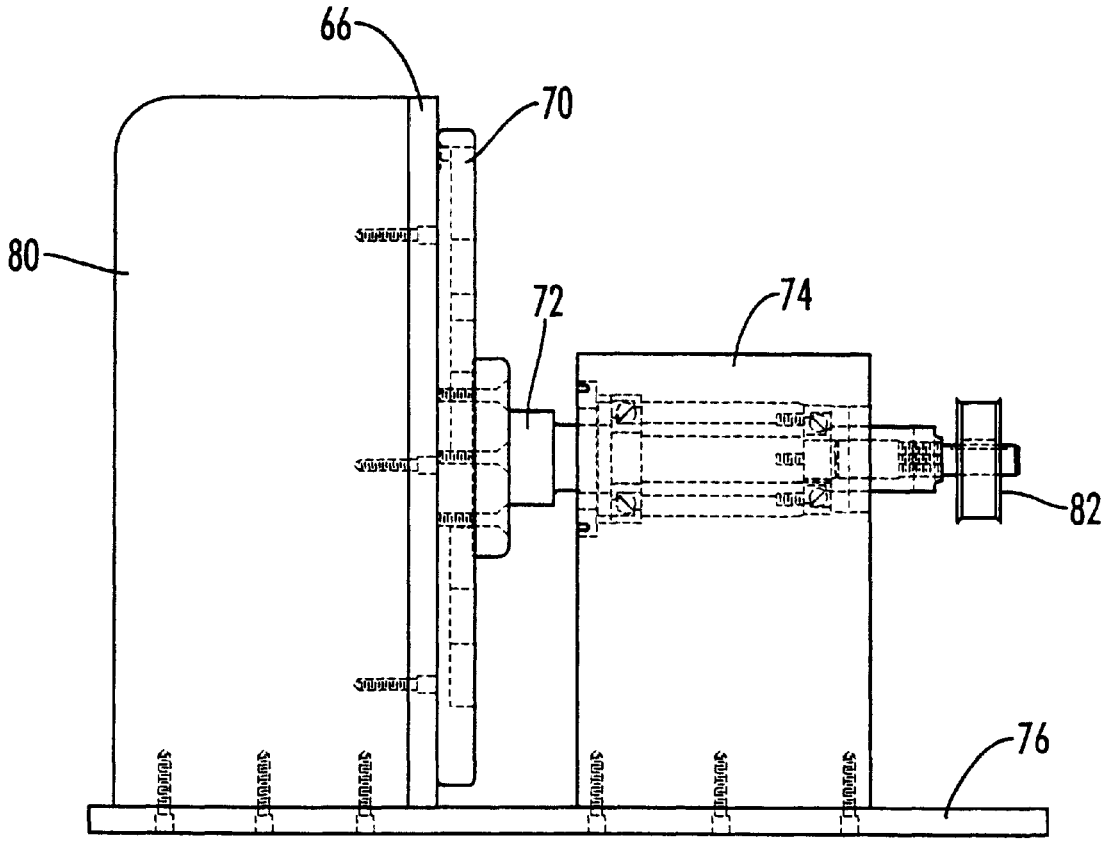
FIG. 6 is a right side elevation view of the multi-plexer of FIG. 4.
Figure 8:
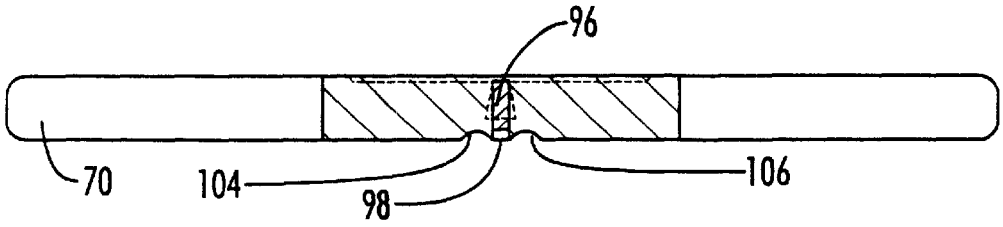
FIG. 8 is a plan partially sectioned view taken along line 8—8 of the rotor of FIG. 7.

Referring now to FIGS. 4, 5 and 6, the details of construction of the multi-plexer 42 are illustrated. The multi-plexer 42 includes a stationary member or stator 64 having a stationary face 66. Each of the light supply conduits 36, which may also be referred to as stationary light input conduits 36, has its second end 40 attached to the stator 64 so that an outlet end 68 thereof (see FIG. 9) is directed outwardly from the stationary face 66.

The multi-plexer 42 further includes a rotor 70, which may also be referred to as a movable member 70, mounted relative to the stationary member 64 to move in a predetermined motion relative to the stationary member 64.

As is best seen in FIGS. 4, 5 and 6, the rotor 70 is bolted to a rotor shaft 72 which rotates within a bearing block 74 which is in turn bolted to a base plate 76.

The stator 64 is in turn supported rigidly from the base plate 76 by gusset plates 78 and 80 which are also bolted to the base plate 76.

The rotor shaft 72 has a pulley 82 attached to the opposite end thereof. Pulley 82 is driven by a drive belt 84 which is in turn driven by a pulley 86 attached to a drive shaft 88 of electric motor 90 which is supported from the base plate 76.

In one embodiment of the present invention, the rotor 70 will be rotated at a speed of 6,000 rpm relative to the stator 64.

As is best seen in FIG. 5, the stator 64 has a plurality of holes 92 defined therethrough in a circular pattern disposed about the axis of rotation 94 of rotor shaft 72. In the embodiment illustrated in FIG. 5, there are 72 holes 92 located 5° apart about axis 94. Sixty-four of the holes 92 are utilized to receive the sixty-four individual light supply conduits 36. The other eight are blank. These eight blank holes are located 45° apart and provide a "dark" reading which can be used to index the signals flowing from the multiplexer.

Figure 7:
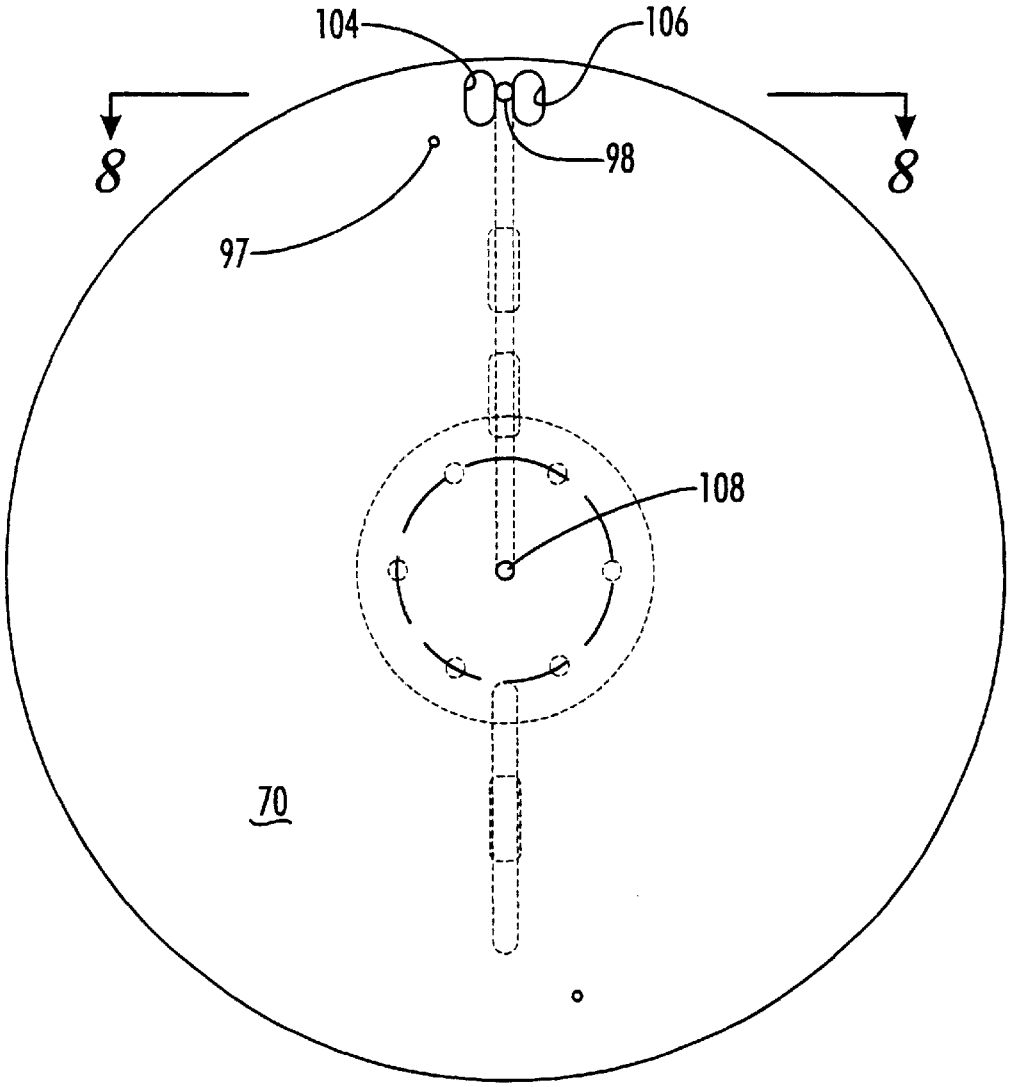
FIG. 7 is a front elevation view of the rotor of the multi-plexer of FIG. 4.

Another means of indexing the light signals flowing through the multi-plexer 42 is provided by a pair of openings 95 (see FIG. 5) and 97 (see FIG. 7) in the stator 64 and rotor 70, respectively. When those holes are aligned during each rotation of rotor 70, a light from a LED source (not shown) passes therethrough and is detected by a photodetector (not shown) located opposite the LED source to generate an electrical index pulse signal which is carried over signal line 62 to microprocessor 54.

The rotor 70 carries a U-shaped glass fiber 96 which may also be referred to as a movable light conduit 96. The U-shaped fiber 96 is attached to the rotor 70 as further described below, so that the fiber 96 rotates with the rotor 70. The U-shaped fiber 96 has an inlet end 98 arranged to sequentially pass across and receive light from the ends 68 of each of the stationary light input conduits 36 as the U-shaped glass fiber 96 is rotated by rotor 70 in its predetermined circular path relative to the stationary member 64.

Figure 9:
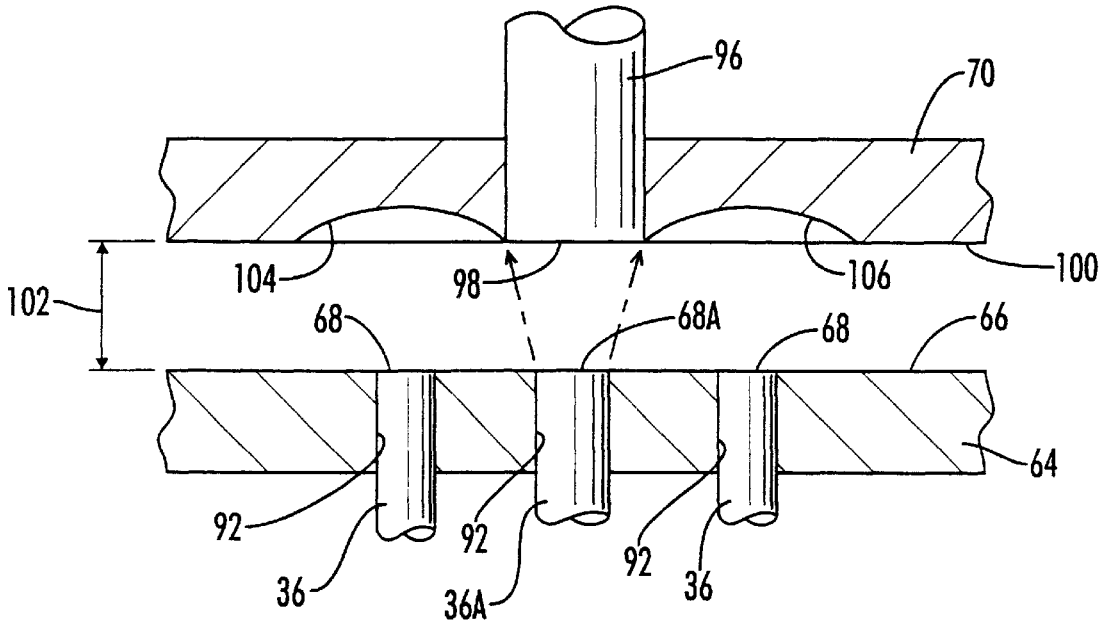
FIG. 9 is an enlarged schematic sectioned plan view of a portion of the rotor and stator of the multi-plexer of FIG. 4, illustrating the manner in which light rays are transmitted across a gap between the stator and rotor.

As is best seen in the enlarged view of FIG. 9, the rotor 70 has a rotor face 100 which it is parallel to and spaced from the stationary face 66 to define a gap 102 therebetween.

The U-shaped fiber 96 is mounted in the rotor 70 by machining a radially extending slot communicated by a pair of end bores to the rotor face 100. The U-shaped fiber 96 is placed in the slot and potted in place.

The rotor face 100 has a pair of recesses 104 and 106 defined therein on tangentially opposite sides of the end 98 of U-shaped fiber 96.

In FIG. 9, a selected one of the light supply fibers 36 designated as 36A is shown in direct registry opposite the gap 102 from the inlet end 98 of U-shaped fiber 96. It will be appreciated that some light from other adjacent optical fibers 36 will bounce back and forth across gap 102 between stator 64 and rotor 70 and some small amount of such reflected light from adjacent fibers will enter the end 98 of U-shaped fiber 96. The purpose of the recesses 104 and 106 in rotor face 100 adjacent the fiber end 98 is to reduce the amount of such reflected light which will enter the fiber 96. It will be appreciated that the concave recesses 104 and 106 in surface 100 will interfere with these reflections and cause them to be directed to a significant extent away from end face 98 of U-shaped fiber 96.

As seen in FIG. 4, the U-shaped fiber 96 has an outlet end face 108 located concentric with the central axis 94 and facing the stationary member 64.

The common light transfer conduit 44 previously identified with regard to FIG. 1, includes a light randomizing rod 110 which is fixedly mounted in a central bore 112 formed through the stator 64 and co-axial with the axis of rotation 94 of rotor shaft 72. Thus, the light randomizing rod 110 is permanently located directly opposite the outlet end 108 of U-shaped fiber 96 across the gap 102 therefrom, as is best schematically illustrated in FIG. 10.

Figure 10:
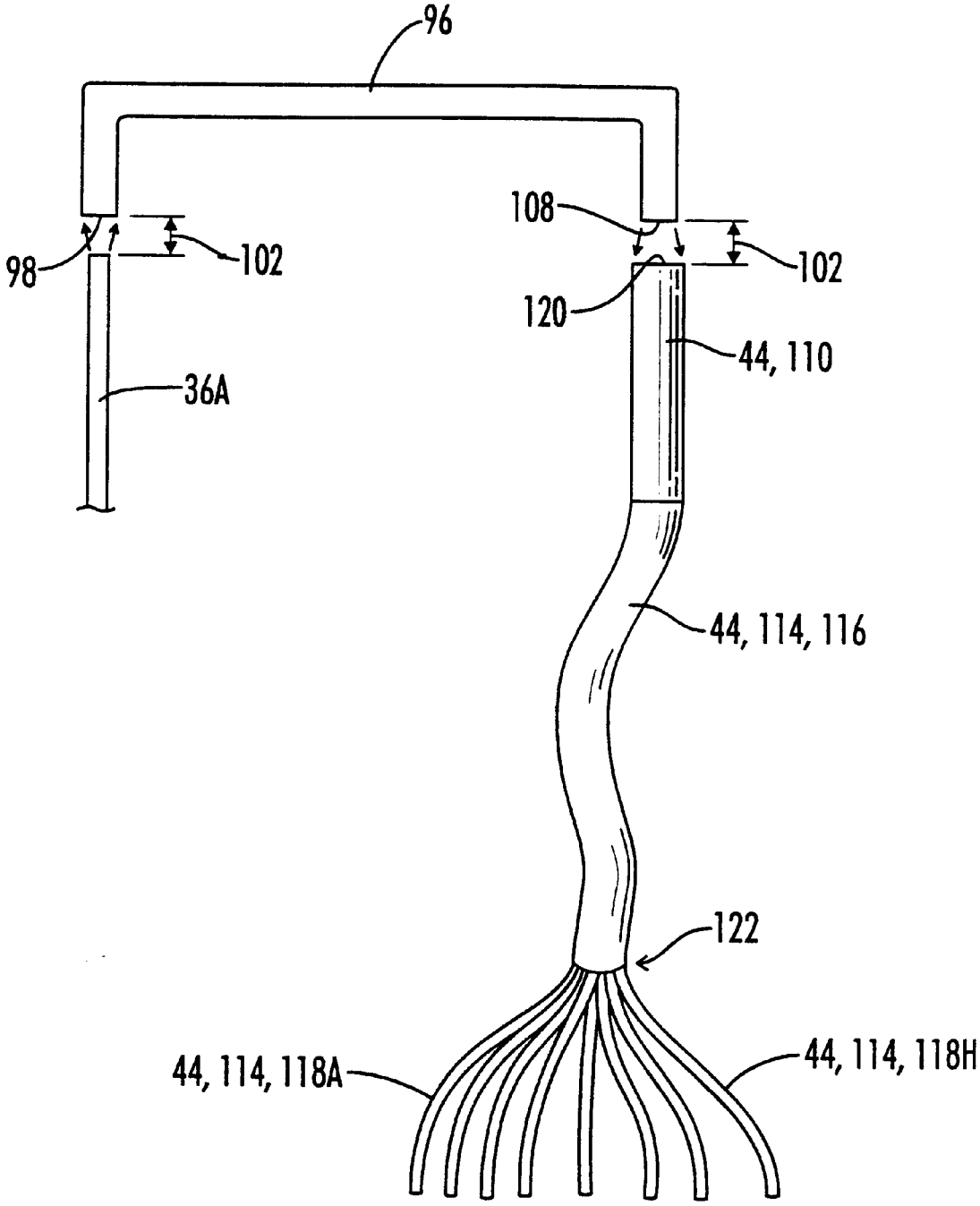
FIG. 10 is a schematic illustration of the common light transfer conduit which carries light from the multi-plexer to the control system and analyzer unit of the system of FIG. 1.

As further shown in FIG. 10, the common light transfer conduit 44 comprises a bundle 114 of glass fibers having a completely bundled upstream portion 116 and having a split downstream portion 118 split into a plurality of parallel downstream bundle portions 118A–118H.

With further reference to FIG. 10, some details of construction of the various light conducting components of the invention will be described. In general, each of the stationary light input conduits 36 can be described as having a first diameter, and the diameter of all of the stationary light input conduits 36 are preferably equal. In one exemplary embodiment, the light supply conduits 36 have a diameter of one-eighth inch.

The U-shape rotating fiber 96 has a diameter greater than the diameter of the light supply fibers 36, and in one exemplary embodiment the U-shaped fiber 96 has a diameter of three-sixteenth inch. The light randomizing rod 110 of the stationary common light transfer conduit 44 has a third diameter, which in this example is one-quarter inch, and is thus greater in diameter than the U-shaped tube 96. As is schematically illustrated in FIG. 10, the purpose for the successively increasing diameter of components 36, 96 and 44, respectively, is to allow for a spreading of the light beam each time it must pass through the air as it crosses gap 102. In this example, gap 102 is 0.050 inches. Thus, when a light beam passes from one of the light supply fibers 36 across gap 102, it will diverge and substantially completely fall on the inlet end 96 of the larger diameter fiber 96, and when that same light beam then exits end 108 of fiber 96 and again passes across gap 102, it will again diverge and fall on an inlet inface 120 of the still larger diameter randomizing rod 110. Thus, by increasing the diameters of the downstream light conduits whenever the light must pass across an air gap, loss of light energy is substantially prevented.

In general, the inlet end 98 of the movable light member 96 is spaced from the outlet ends 68 of the supply fibers 36 by the distance 102 as the movable member 96 moves across each of the outlet ends of the stationary conduits 36. That distance 102 is such that a circular beam of light exiting each stationary conduit 36 spreads to a diameter substantially equal to the diameter of the movable light conduit 96 as the beam crosses the distance 102 from each stationary light conduit 36 to the movable light conduit 96.

The light randomizing tube 110 is a straight glass rod which is provided in order to allow a given stream of light energy to make multiple reflections therein and thus be generally homogenized in content across the diameter of the rod 110 prior to the time it reaches the bundle 44 of glass fibers. It will be appreciated that the bundle 44 contains a large number of very small fibers. In the absence of the randomizing tube 110, it is possible that different fibers of bundle 44 would receive significantly different amount of light energy due to an image from the input comprising light and dark areas. The rod 110 randomizes the light rays geometrically and destroys any image information. Thus, by use of the light randomizing rod 110 there is a more homogeneous signal light energy provided to each of the multitude of fibers making up the bundle 44.

The fiber bundle 44 is utilized in order to allow a given signal collected by one of the collector elements 34 of collector 28 to be broken down into a plurality of substantially identical parallel light streams which can each be separately analyzed to analyze a plurality of different parameters of the light energy collected at a given point in time by one of the collector elements 34. Thus, it is important in constructing the fiber bundle 114 that when the fibers of the upstream completely bundle portion 116 are split at junction 122 into the plurality of downstream bundle portions 118 that there be a random selection of fibers for each bundle portion 118 from throughout the cross section of the upstream completely bundled portion 116. This will further aid in providing uniform homogenous light energy streams to each of the bundle portions 118.

Figure 2:
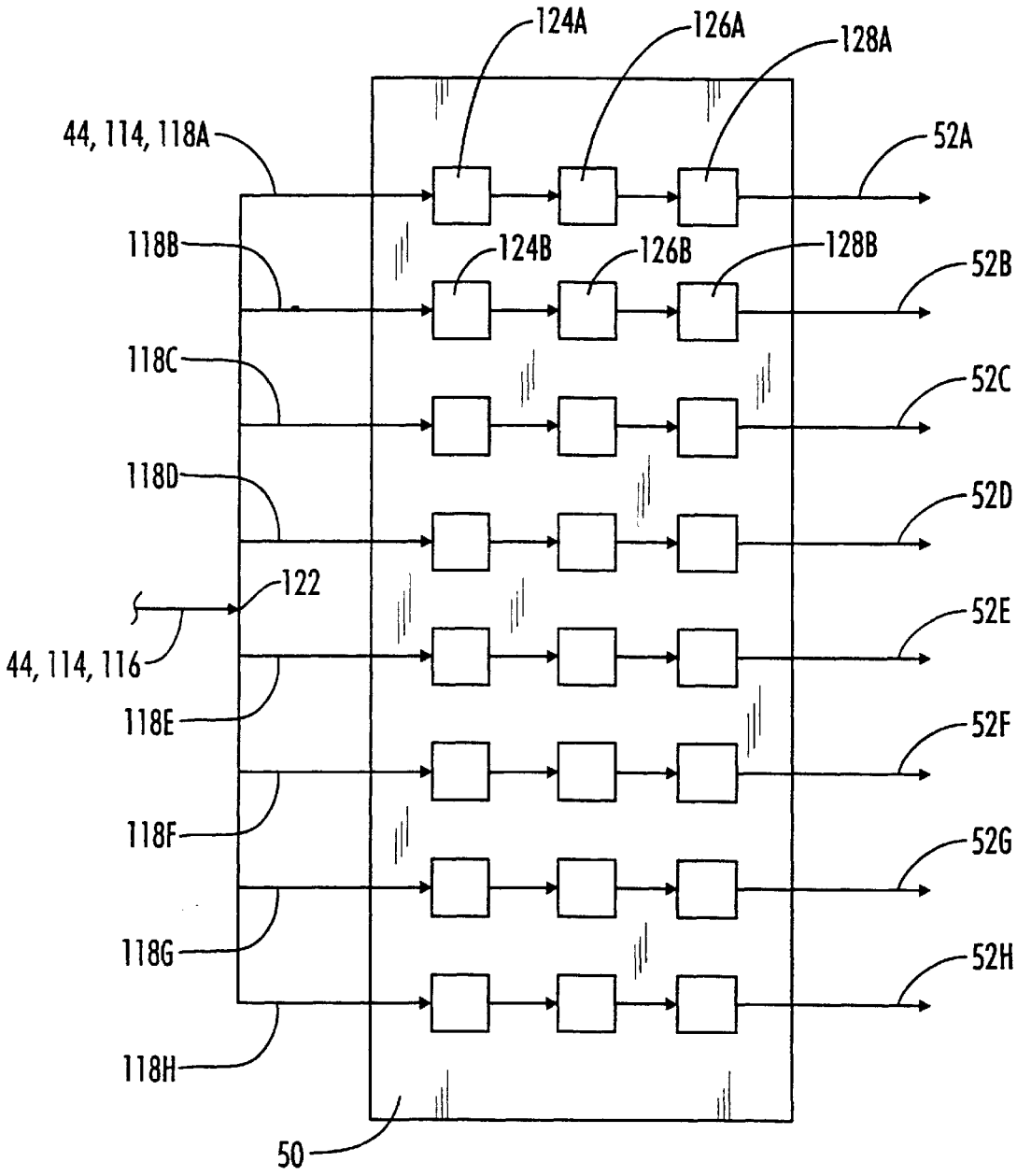
FIG. 2 is a schematic illustration of the optical filter board of the system of FIG.

As previously noted in FIG. 1, each of the downstream bundle portions 118 of common light transfer conduit 44 is connected to the optical filter board 50. The details of construction of optical filter board 50 are best shown in FIG. 2.

As previously noted, one preferred manner of operation of the system 10 is to utilize it to analyze and detect the color of the various articles 14. The system 10 may be also utilized to analyze various other properties of the articles 14, including any characteristic which is capable of determination by examination of the light or in general the electromagnetic radiation reflected off of the articles 14. For example, different types of plastic material, such as PET, PVC and HDPE, are known to have distinct and identifiable reflected frequencies of electromagnetic radiation in the infrared portion of the spectrum.

When it is desired to analyze the color and/or material of the articles 14, this can be accomplished by splitting the light reflected from the article 14 into a plurality of parallel streams with the parallel bundle portions 118 and then analyzing each stream for a different color or frequency component. For example, with reference to the bundle portion 118A of FIG. 2, the light energy content thereof is first passed through an optical filter 124A which allows a certain frequency of light to pass therethrough, for example, those frequencies normally referred to as "red", which filtered light energy then falls upon a photoelectric detector element 126A, which generates an analog electrical signal which is passed to an analog to digital converter 128A thus resulting in a digital signal representative of the red content of the light energy collected at collector 28, which digital signal is passed along electrical conductor 52A to the microprocessor 54. The optical filter 124A may be a glass disc selected to pass the selected band of light. The photoelectric detector element 126A may be a germanium or silicon diode. The analog to digital converter will be part of an amplifier circuit.

Similarly, that portion of the light energy passing through downstream bundle portion 118B passes through a filter 124B, which for example, might be chosen to pass "green" light, which then falls upon a photoelectric detector 126B, which generates an electrical signal which is digitized by analog to digital converter 128B, which then passes through electric conductor 52B to the microprocessor 54. Similarly, other color components of the light energy can be filtered, detected and converted into digital signals representative of various color components, including non-visible components such as ultraviolet and/or infrared if desired.

The microprocessor 54 then compares the frequency content of the various components of the light energy to stored information identifying the frequency breakdown of various colors of plastic bottles or other articles which are being examined, and via that comparison identifies the color of the article 14. If the particular article being examined is one which it is desired to pass to the primary destination 20, then the microprocessor 54 will not actuate one of the deflector air jets 58 or 59, but if the particular article 14 is one which it is desired to deflect to an alternative destination such as second chute 60 or third chute 61, then an appropriate air jet 58 or 59 aligned with the respective article 14 will be actuated by microprocessor controller 54 by a signal sent over signal conduit 56 thus directing one or more jets of air against the particular article 14 to deflect it toward the desired chute 60 or 61.

By use of the multi-plexer 64, a single optical filter board 50 including the various electronic components just described with regard to FIG. 2, can be utilized to process the light energy from multiple ones of the collector elements 34. It will be appreciated that in the absence of the multiplexer 42, it would be necessary to have an optical fiber bundle 44 and optical filter board 50 associated with each of the sixty-four light supply fibers 36, which would be prohibitive both in the space occupied and the expense of the components.

With the present system, a single processor board 50 can be utilized to process the light energy from all sixty-four of the collector elements 34.

It is noted that the movable light transmitting conduit 96 does not have to be U-shaped. For example, it would be possible to have two stationary members with the rotor 70 received therebetween. The input conduits 36 could be attached to one stationary member and the output conduit 44 attached to the other. Then the movable member 96 would take on an S-shape with its inlet end facing one stationary member and its outlet end facing the other stationary member.

The Retro-reflector

Figure 11:
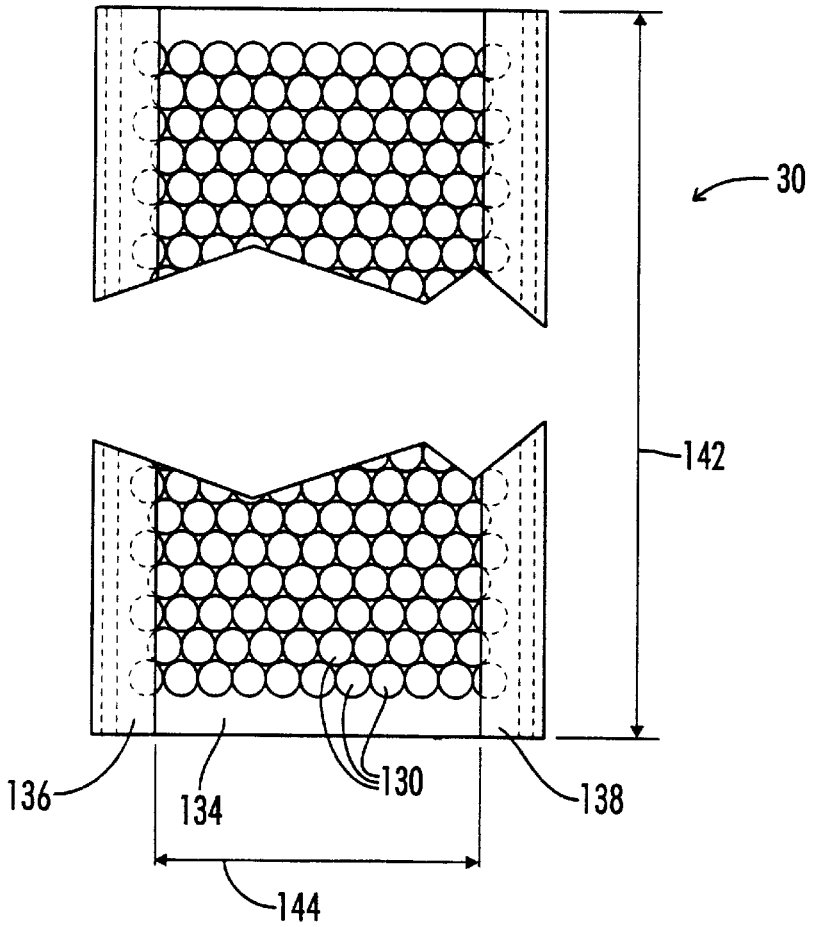
FIG. 11 is a plan view of the reflector of FIG. 1.
Figure 12:
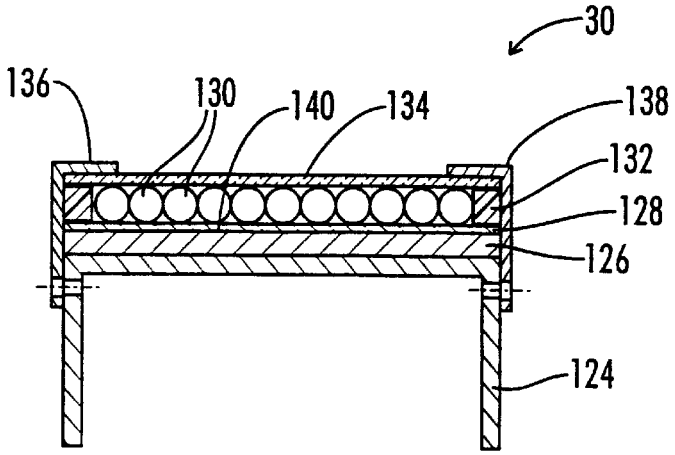
FIG. 12 is an elevation sectioned view of the reflector of FIG. 11.
Figure 13:
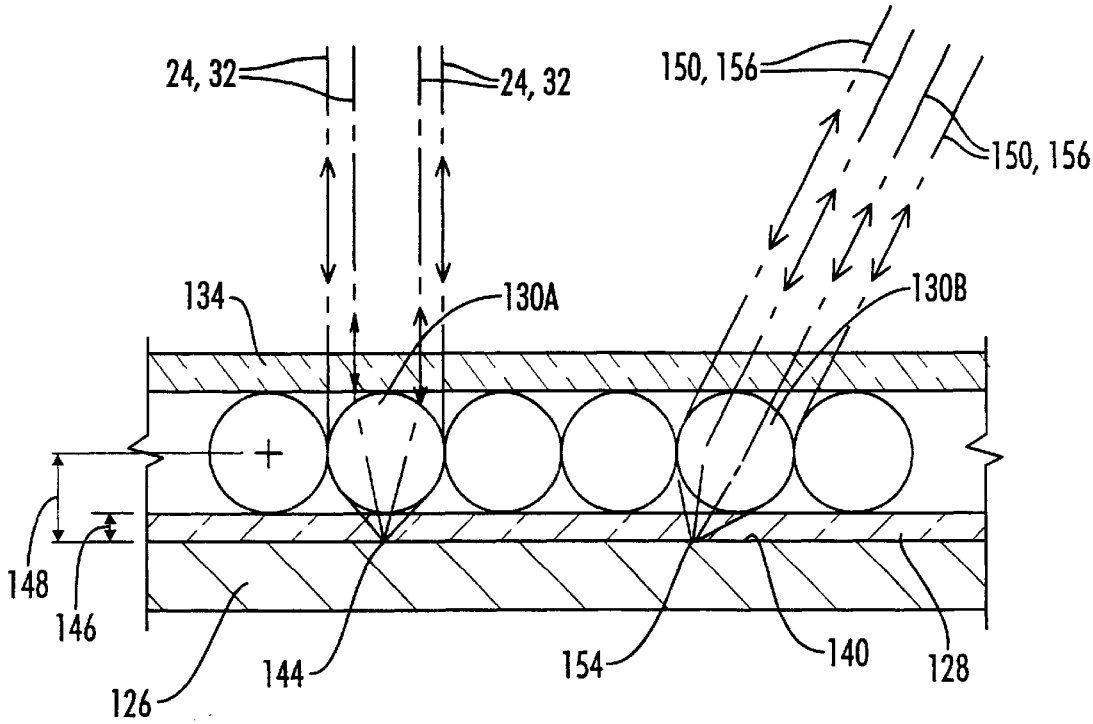
FIG. 13 is an enlarged sectioned elevation view of a portion of the reflector shown in FIG. 12, illustrating the optical features of the reflector.

Turning now to FIGS. 11, 12 and 13, the details of construction of the retro-reflector 30 are thereshown. The reflector 30 includes a mounting channel 124 upon which is supported a back plate 126, a transparent spacer plate 128, a layer of transparent spheres 130, a rubber gasket 132 surrounding the layer of spheres 130 and a transparent cover plate 134. All of these components are held in a sandwiched relationship by angle clamps 136 and 138 which are attached to the mounting channel 134. The back plate 126 is preferably constructed of white glazed ceramic tile which has a diffuse reflective upper surface 140.

As is seen in FIG. 11, the layer of transparent spheres 130 are close packed so that each interior sphere contacts six surrounding spheres.

The reflector 30 has a width 142 which extends across the width of the conveyor belt 12, and in one example, the width 142 is sixty-eight inches for use with a conveyor belt having a width of forty-eight inches. The reflector 30 has a functional length 144 between clamps 136 and 138, which in one example may be three and three-quarter inches. It is noted that the terms width and length are used to coincide with the width of the conveyor belt 12 and the direction of travel of articles from the conveyor belt 12.

The retro-reflector 30 is designed so that light entering the cover plate 134 in an incident direction is focused by the spheres 130 onto the diffuse reflective surface 140 and reflects back to the spheres and is refocused by the spheres 130 to exit through the cover plate 134 in an exit direction opposite and substantially parallel to the incident direction. The manner in which this occurs is best understood with reference to the schematic optical diagram of FIG. 13.

For example, with reference to the sphere 130A, incident light energy 24 falling there upon in a direction substantially perpendicular or normal to the transparent cover plate 134 is focused by the sphere 130A, which acts as a lens, onto a spot 144 on the surface 140 of the back plate 126. The sphere 130A has a focal length, as does any lens, and preferably the spacer plate 128 is selected to have a thickness 146 so that the radius of sphere 130A plus the thickness 146 is substantially equal to a focal length 148 of the sphere 130A so that the spot 144 is reduced to essentially a point or extremely small spot of light energy.

For example, spheres 130 may have a diameter of 0.39 inch, and a focal length of 0.3 inch, and the thickness 146 may be 0.1 inch.

This white light from spot 140 reflects in all directions due to the diffuse surface, but due to the proximity of the sphere 130A the vast majority of the reflected light reflects back to the sphere 130A and is refocused to exit as reflected light 132 in the direction opposite of and substantially parallel to the incident light 24.

Referring now to the right hand side of FIG. 13, an example of incident light entering at an angle, such as would result from background reflections from an article, are shown. The incident rays 150 are focused by sphere 130B on spot 154. Again, most of the reflected light returns to sphere 130B due to its proximity. That reflected light is refocused by sphere 130B and exits as rays 156 along the same path as incident rays 150. Thus, the retro-reflector cuts down on stray light seen by the collector 34. Stray light comes from objects 14 that are not directly in the field of view of a collector 34.

Methods of Operation

The method in which the system 10 operates to sort articles by color, material composition or other parameter can be generally described as follows.

As schematically illustrated in FIG. 1, the conveyor belt 12 propels the stream of articles 14 through the air space 18.

While the articles are flying through the air space 18, light energy is shined thereon by source 22, which preferably is a white light source which also includes infrared light energy. A first portion of that light is reflected from an articles, such as article 14D passing through the air space 18, and that reflected light is collected by collector 28 and analyzed in analyzer 48 to determine the color of the particular article 14D. If the article is transparent, a second portion of light energy will pass through the article, reflect off reflector 30, then pass back through the article to the collector 28. Then the microprocessor controller 54 will selectively actuate the air jets 58 and/or 59 to sort the stream of articles 14 to fall into the first, second and third chutes 20, 60 and 61 based upon the color of the articles. By use of the multi-plexer 42, the reflected light energy can be collected in an array of collector elements 34 and then sequentially transferred from each of the collector elements to the common analyzer unit 48 wherein the light from each collector element is analyzed.

By providing the retro-reflector 30 on the opposite side of the airspace 18 from the light source 22 and collector 28, when no article is present in the airspace 18 light from source 22 is substantially completely reflected by reflector 20 thus allowing the sensors of analyzer 48 to be calibrated to a pure white color.

In the multi-plexer 42, an intermediate light conduit 96 is rotated to sequentially communicate each of the light conductors 36 with the common light conduit 44. In the common light conduit 44, the light is randomized by the light randomizing rod 110 before the light is passed to the fiber bundle 114 where it is split into multiple light streams in each of the downstream bundle portions 118. Then the light energy is passed to the optical filter board 50 wherein each of the multiple light streams is filtered to pass a selected frequency band of light to its respective sensor 126 to create an electrical signal which is then amplified and digitized and passed to the microprocessor 54 where the signals are analyzed to determine the characteristic frequency spectra of the light collected by each collector element 34.

A number of advantages are provided by collecting the reflected light energy from the articles 14 as they fly through the airspace 18, rather than analyzing the articles 14 as they lie on a background surface such as the conveyor belt 12 which is the conventional procedure.

A first advantage is that by examining the article 14 while it passes through the airspace 14D, the retro-reflector 30 can be utilized to provide a 100% accurate white color calibration at any time at which there is not an article 14 present between the collector 28 and the reflector 30. This is contrasted to a system wherein the articles are examined while carried by a conveyor belt 12, because the conveyor belt 12 cannot reliably be used as a reference surface. Conveyor belt 12 is typically a black rubber conveyor, and it is not possible to construct it of a pure white reflecting surface, because the same would simply become dirty in use.

A second advantage of examining articles as they fly through the airspace 18 is that it is much easier to identify a clear plastic bottle in the airspace 18 than it is to identify a clear plastic bottle lying on a black conveyor belt 12. It will be appreciated that the clear plastic bottle will have a different reflective signal than does the 100% reflection of the retro-reflector 30.

A third advantage of examining articles as they fly through the airspace 18, is that it is possible to identify a black object, such as a black plastic bottle, as it flies through the airspace. This is contrasted to the extreme difficulty of identifying a black plastic bottle lying upon a black conveyor belt 14.

The system just described is particularly well suited for sorting plastic bottles and/or other packaging from a stream of recycled waste materials. It can also be utilized to sort glass articles, paper articles, food items, and any other articles which can be sorted by color or by material content.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention as defined by the appended claims.

What is claimed is:

1. A system for sorting articles, comprising:

a feed conveyor for launching the articles across an airspace toward a first destination;

a light source for shining light energy on the articles in the airspace;

a collector for collecting light energy reflected from the articles in the airspace;

a retro-reflector located on an opposite side of the airspace from the light source and the collector, the retro-reflector being constructed to reflect light back in a direction opposite and parallel to a direction at which the light falls upon the reflector;

a deflector for deflecting selected articles toward an alternative destination as the articles fly across the airspace; and a control system, operably connected to the collector and the deflector, for actuating the deflector in response to a sensed parameter of the light energy collected in the collector.

2. The system of claim 1, wherein the retro-reflector comprises:

a back plate;

a transparent cover plate; and a layer of transparent spheres of equal diameters sandwiched between the back plate and the cover plate.

3. The system of claim 1, wherein:

the light source is a source of white light;

the control system includes a sensor; and the retro-reflector provides substantially total reflection of white light so that the sensor can be calibrated whenever an article is not present in the airspace.

4. The system of claim 1, the articles including some clear plastic bottles, wherein:

the control system can sense the presence of a clear plastic bottle in the airspace as contrasted to a total reflection from the retro-reflector.

5. The system of claim 1, further comprising:

the collector including an array of collector elements spaced across a width of the conveyor;

a plurality of light supply conduits, each having a first end connected to one of the collector elements and each having a second end;

a common light transfer conduit;

a light beam multiplexer for receiving light from the second end of each of the light supply conduits, and for sequentially transferring the light from each light supply conduit to the common light transfer conduit; and the control system including an analyzer connected to the common light transfer conduit for analyzing the light from all of the collector elements.

6. The system of claim 5, wherein the light beam multiplexer comprises:

a stationary member connected to the second ends of each of the light supply conduits and connected to the common light transfer conduit; and a rotor carrying a light conducting tube for sequentially conducting light from each light supply conduit to the common light transfer conduit as the rotor rotates relative to the stationary member.

7. The system of claim 6, wherein the common light transfer conduit comprises:

a bundle of glass fibers having a completely bundled upstream portion and having a split downstream portion split into a plurality of parallel bundle portions; and the analyzer includes a plurality of different sensors, one of which is connected to each split downstream portion, for analyzing a plurality of different parameters of the light carried in the plurality of parallel bundle portions.

8. The system of claim 7, wherein the common light transfer conduit further comprises:

a light randomizing tube upstream of the bundle of glass fibers.

9. A method of sorting a stream of articles including articles of different properties, comprising:

(a) providing a reflector on one side of an airspace and providing a light source and light collector on an opposite side of the airspace from the reflector;

(b) propelling the stream of articles through the airspace; and (c) while the articles are flying through the airspace:

(c)(1) shining light on the articles;

(c)(2) reflecting a first portion of the light incident on the articles from the articles;

(c)(3) transmitting a second portion of the light incident on the articles through the articles, then reflecting the transmitted light off the reflector back through the articles;

(c)(4) analyzing both the reflected first portion of the light and the transmitted second portion of the light to determine the properties of the articles; and (c)(4) sorting the articles into first and second product streams based upon color of the articles.

10. The method of claim 9, wherein the analyzing step comprises:

collecting reflected light in an array of collector elements;

sequentially transferring light from each of the collector elements to a common analyzer unit; and analyzing the light from each collector element in the common analyzer unit.

11. The method of claim 9, further comprising:

when no article is present in the airspace between the light source and the reflector, reflecting light from the reflector back to the collector to calibrate the collector.

12. The method of claim 9, further comprising:

in step (b), the stream of articles includes plastic bottles;

in step (c)(2), reflecting less light from the clear plastic bottle than would be reflected from the reflector; and in step (c)(4), determining that the article is a clear plastic bottle.

13. The method of claim 9, further comprising:

in step (b), propelling the stream of articles from a black conveyor belt; and in step (c)(4), determining the presence of a black plastic bottle in the airspace which could not be detected against a black conveyor belt background.

14. The method of claim 9, wherein:

the step of reflecting light from the reflector includes reflecting light in a direction opposite of and substantially parallel to a direction from which the light was incident upon the reflector regardless of the direction of incidence.

15. The method of claim 9, wherein step (c)(1) further comprises shining white light including infrared light on the articles.

* * * * *

UNITED STATES PATENT AND TRADEMARK OFFICE

CERTIFICATE OF CORRECTION

PATENT NO. : 6,497,324 B2
DATED : December 24, 2002
INVENTOR(S) : Doak et al.

It is certified that error appears in the above-identified patent and that said Letters Patent is hereby corrected as shown below:

Column 3,
Line 2, insert "1" after -- FIG. --.
Line 34, insert -- to -- before "the".

Column 12,
Line 17, indent "(c)(l)".
Line 27, replace "(c)(4)" with -- (c)(5) --.

Signed and Sealed this

Twenty-fifth Day of March, 2003

JAMES E. ROGAN
*Director of the United States Patent and Trademark Office*